US006773085B2

(12) United States Patent
Sakuma

(10) Patent No.: US 6,773,085 B2
(45) Date of Patent: Aug. 10, 2004

(54) INK JET RECORDING APPARATUS AND RECORDING METHOD

(75) Inventor: Katsuhisa Sakuma, Chiba (JP)

(73) Assignee: SII Printek Inc., Chiba (JP)

( * ) Notice: Subject to any disclaimer, the term of this patent is extended or adjusted under 35 U.S.C. 154(b) by 0 days.

(21) Appl. No.: 10/306,691

(22) Filed: Nov. 27, 2002

(65) Prior Publication Data

US 2003/0137565 A1 Jul. 24, 2003

(30) Foreign Application Priority Data

Dec. 4, 2001 (JP) ..... 2001-369915

(51) Int. Cl.[7] ..... B41J 29/38; B41J 2/045
(52) U.S. Cl. ..... 347/11; 347/68
(58) Field of Search ..... 347/9–11, 68, 347/69

(56) References Cited

U.S. PATENT DOCUMENTS 6,106,091 A * 8/2000 Osawa et al. ..... 347/9
6,286,923 B1 * 9/2001 Sugahara ..... 347/10
6,437,964 B1 * 8/2002 Takamura et al. ..... 361/235

FOREIGN PATENT DOCUMENTS

| | | |
|---|---|---|
| GB | 2374833 | 10/2002 |
| JP | 6297708 | 10/1994 |
| JP | 02046263 | 2/2002 |

* cited by examiner

*Primary Examiner*—Judy Nguyen
(74) *Attorney, Agent, or Firm*—Adams & Wilks

(57) ABSTRACT

An ink chamber plate 20 for defining a common ink chamber 21 communicating with chambers 17 is bonded onto a substrate 16 on which the chambers 17 are provided. The common ink chamber 21 is provided with a section 30 for partitioning the chambers 17 and the common ink chamber 21 and the partitioning section 30 is provided with a plurality of interconnecting holes 31 for defining the pump length, at an interval equivalent to the pump length, along the longitudinal direction of the chamber. A drive means generates a drive field in both the sidewalls 18 defining the chamber 17 such that a preliminary drive field for temporarily increasing the volume in the chamber 17 has a drive time substantially equal to that of an ejection drive field for ejecting ink by temporarily reducing the volume in the chamber 17 continuously to the preliminary drive field.

5 Claims, 16 Drawing Sheets

FIG. 11A
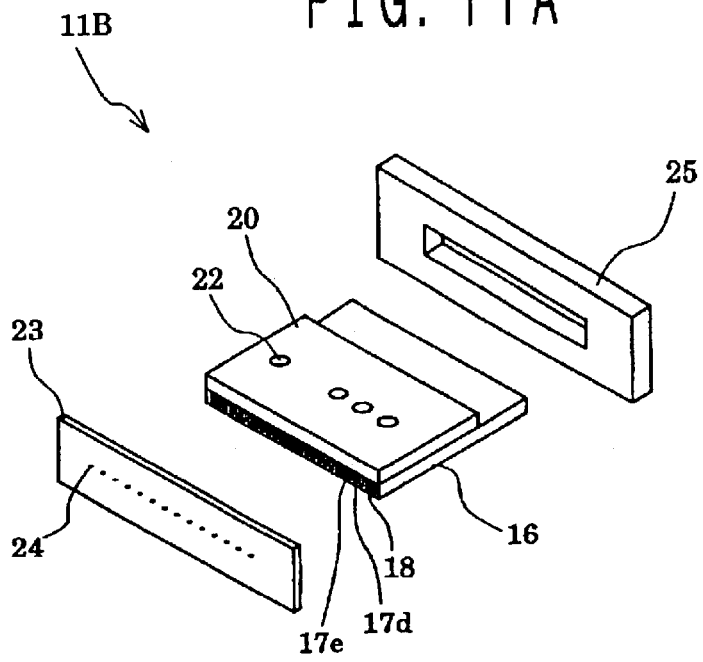
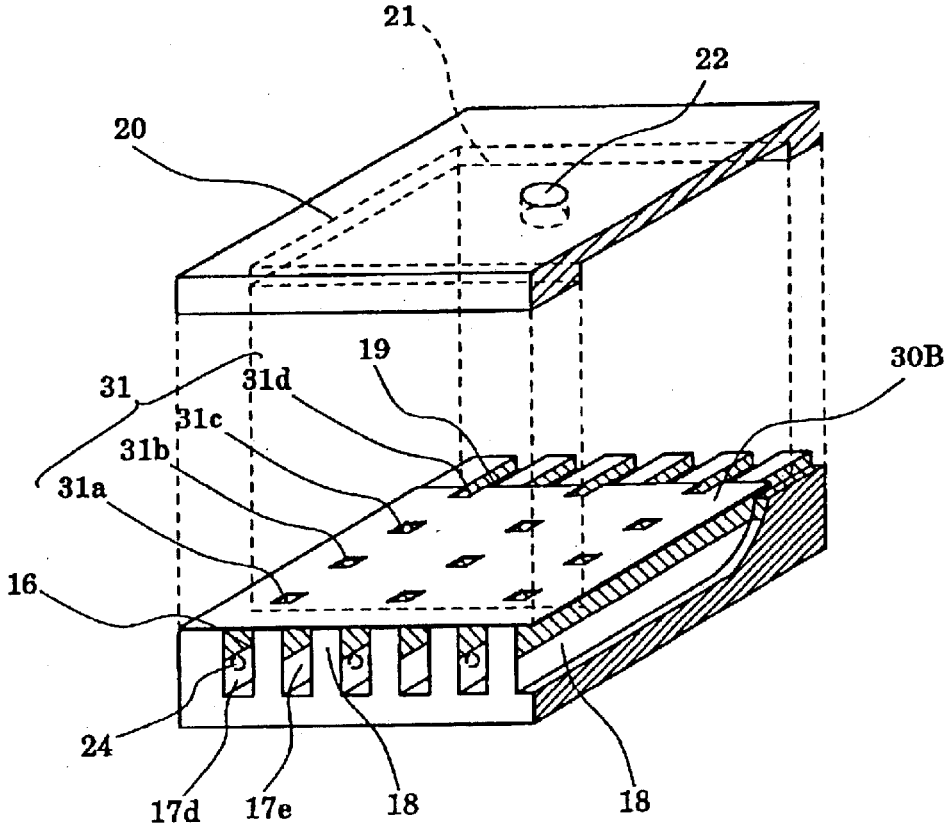
FIG. 11B

COMPARATIVE EXAMPLE OF EMBODIMENT

COMPARATIVE EXAMPLE OF EMBODIMENT

INK JET RECORDING APPARATUS AND RECORDING METHOD

BACKGROUND OF THE INVENTION

1. Field of the Invention

The present invention relates to an ink jet recording apparatus used in a printer or in a facsimile machine for example, and to an ink jet recording method.

2. Description of the Related Art

Conventionally, there is known an ink jet recording apparatus that records characters and images on a recording medium using a ink jet head which ejects ink from a plurality of nozzles. In such an ink jet recording apparatus, the nozzles of the ink jet head are provided in a head holder so as to oppose the recording medium, and this head holder is mounted on a carriage to be scanned in a direction orthogonal to a conveying direction of the medium to be recorded.

A schematic exploded view of an example of a head chip of such an ink jet head is shown in FIG. 13 and a sectional view of main parts of the same is shown in FIG. 14. As shown in FIGS. 13 and 14, a plurality of chambers 102 are provided in parallel with each other in a piezoelectric ceramic plate 101, and each chamber 102 is separated by side walls 103. An end portion in a longitudinal direction of each chamber 102 is extended to an end surface of the piezoelectric ceramic plate 101 and the other end portion is not extended to the other end surface, making the chamber 102 become gradually shallower. In addition, electrodes 105 for applying a driving electric field are formed on surfaces on opening-side of both the side walls 103 in each chamber 102 along its longitudinal direction.

A cover plate 107 is bonded to the piezoelectric ceramic plate 101 on the opening side of the chambers 102 by using adhesive 109. The cover plate 107 includes a common ink chamber 111 to be a recessed portion communicating with the other end portion of each chamber 102 where it is shallower, and an ink supply port 112 that is bored from the bottom portion of this common ink chamber 111 in a direction opposite to the chamber 102.

In addition, a nozzle plate 115 is bonded to an end surface of a bonded body of the piezoelectric ceramic plate 101 and the cover plate 107 in which the chambers 102 are opened, and nozzle openings 117 are formed in the nozzle plate 115 at positions opposing the respective chambers 102.

Note that, a wiring substrate 120 is fixed to the surface of the piezoelectric ceramic plate 101 which is on the side opposite from the nozzle plate 115 and on the side opposite from the cover plate 107. Wiring 122 connected to each electrode 105 by bonding wires 121 and the like is formed on the wiring substrate 120, and a driving voltage can be applied to the electrodes 105 via this wiring 122.

In a head chip configured in this way, when each chamber 102 is filled with ink from the ink supply port 112 and a predetermined driving electric field is caused to act on the side walls 103 on both sides of the predetermined chamber 102 via the electrode 105, the side walls 103 are deformed to change the volume of the predetermined chamber 102, whereby the ink in the chamber 102 is ejected from the nozzle opening 117.

For example, as shown in FIG. 15, when ink is to be ejected from the nozzle opening 117 corresponding to a chamber 102*a*, a positive driving voltage is applied to electrodes 105*a* and 105*b* within the chamber 102*a*, and electrodes 105*c* and 105*d* which face the electrodes 105*a* and 105*b*, respectively, are grounded. This causes a driving electric field to act on side walls 103*a* and 103*b* in a direction towards the chamber 102*a*, and if this is orthogonal to the polarization direction of a piezoelectric ceramic plate 101, the side walls 103*a* and 103*b* deform towards the chamber 102*a* due to a piezoelectric thickness shear effect to reduce the volume of the chamber 102*a* while increasing the pressure. Thus, ink is ejected from the nozzle opening 117.

In such a head chip, although the time required from when vibration of the side walls caused by ink ejection stops until when the ink pressure in the chamber becomes zero to be ready for next ink ejection depends upon the length of the chamber, the shape of the nozzle opening, and the like, since the chamber is low in sealing property, the sound pressure is repeatedly reflected within the chamber, thus requiring a considerable amount of time for completely attenuating it. Therefore, a problem occurs in that it is difficult to increase the speed of continuous ejection, that is, to increase the printing speed.

Since the time required until the sound pressure attenuates largely varies depending upon the shape of the nozzle opening, in particular, a problem occurs in that it is difficult to control the amount of ejection according to the shape of the nozzle opening.

The chamber is composed of a boundary portion communicating with the common ink chamber, and a pump portion extending from the nozzle opening to the boundary portion, which is driven to eject ink, and the contraction time during which the chamber pressure attenuates depends upon the length of the pump portion, i.e., upon the distance from the nozzle opening to the boundary portion. However, the problem is that, when the pump length is shortened in order to reduce the contraction time, ink ejection characteristics are deteriorated, resulting in unnormal printing operation.

A driving electric field generated in the side walls on both sides of the chamber by one-time ejection consists of a preliminary driving electric field which causes the chamber volume to temporarily increase, and an ejection driving electric field which causes the chamber volume to temporarily decrease subsequently to the preliminary driving electric field. The driving time ratio of the preliminary driving electric field to the ejection driving electric field is AP to 2N×AP (N denotes a natural number, and AP denotes a periodic time that is determined by the pump length and the pressure propagating speed within ink, i.e., a time required from a positive pressure peak to a negative pressure peak). That is, as the preliminary ejection driving generates a negative pressure in the chamber, and the ejection driving electric field generates a positive pressure in the chamber; after the positive pressure has been generated by the ejection driving electric field, the chamber volume is returned to the original volume, thereby causing a negative pressure to be generated in the chamber, and a positive pressure peak generated after 2N×AP after generation of an ejection driving electric field is cancelled by this negative pressure, thus preventing ink leakage or ejection failure.

Therefore, if the driving time ratio of the preliminary driving electric field to the ejection driving electric field is AP to (2N−1)×AP, that is, if the ejection driving electric field is an odd-numbered multiple, a negative pressure peak generated at a period of 2AP after a time AP elapses since an application of ejection driving electric field coincides with the timing of generation of a negative pressure caused by the chamber volume returning to the original volume, thus extraordinarily increasing the negative pressure to thereby cause contamination of air bubbles into the chamber or degradation in the ejection performance. Therefore, the driving time ratio of the preliminary driving electric field to the ejection driving electric field is set to AP to 2N×AP, so that a positive pressure peak generated at a period of 2AP after a time 2AP elapses after an application of ejection driving electric field is cancelled by a negative pressure generated when the chamber volume returns to the original volume. The time involved in ejection using both the preliminary driving electric field and the ejection driving electric field becomes at least 3AP, thus requiring a long ejection time and further requiring the time for contraction of the pressure in the chamber for next ejection. Therefore, a problem occurs in that it is difficult to increase the speed of continuous ejection, in particular.

SUMMARY OF THE INVENTION

The present invention has been made in view of such circumstances, and an object of the present invention is to provide an ink jet recording apparatus and recording method in which the contraction time during which the pressure in a chamber attenuates is reduced and the driving time is reduced to thereby increase the printing speed without deterioration of ink ejection characteristics.

To solve the above-described problems, according to a first aspect of the present invention, there is provided an ink jet recording apparatus comprising: a head chip having chambers which are defined in a substrate and whose end portions in the longitudinal direction thereof communicate with nozzle openings, and electrodes provided on side walls of the chambers; and driving means for applying driving voltages to the electrodes of the head chip to generate driving electric fields in the side walls to change the volumes of the chambers, thereby causing ink filled therein to be ejected from the nozzle openings, the apparatus being characterized in that: an ink chamber plate for defining a common ink chamber communicating with the chambers is bonded on the substrate; the common ink chamber is provided with a partitioning portion for partitioning the chambers and the common ink chamber, the partitioning portion being provided with a plurality of communicating holes for defining a pump length according to the distance from the nozzle openings, along the longitudinal direction of the chambers at an interval equivalent to the pump length; and the driving means performs driving so as to make substantially equal the driving time of a preliminary driving electric field which causes the volumes of the chambers to temporarily increase and the driving time of an ejection driving electric field which causes the volumes of the chambers to temporarily decrease subsequently to the preliminary driving electric field to cause the ink to be ejected, as the driving electric fields to be generated on the side walls.

A second aspect of the present invention relates to the ink jet recording apparatus according to the first aspect of the invention, characterized in that the partitioning portion is formed of a different member.

A third aspect of the present invention relates to the ink jet recording apparatus according to the first or second aspect of the invention, characterized in that the substrate is formed of a piezoelectric ceramic plate, and grooves are formed in the piezoelectric ceramic plate to define the chambers, the chambers communicating with the common ink chamber at openings in end portions in the longitudinal direction of the chambers which are opposite from the substrate.

A fourth aspect of the present invention relates to the ink jet recording apparatus according to the first or second aspect of the invention, characterized in that the side walls made of piezoelectric ceramic are arranged at a predetermined interval on the substrate, and the chambers are defined within the side walls and the common ink chamber is defined in the substrate, the chambers and the common ink chamber being communicated with each other at one end in the longitudinal direction of the chambers.

According to a fifth aspect of the present invention, there is provided an ink jet recording method which comprises applying voltages to electrodes of a head chip that comprises: a substrate in which chambers whose end portions in the longitudinal direction thereof communicate with nozzle openings are defined and the electrodes are provided on side walls of the chambers; and an ink chamber plate bonded on the substrate to define a common ink chamber communicating with the chambers, to thereby change the volumes of the chambers to cause ink filled therein to be ejected from the nozzle openings, the method being characterized in that: the common ink chamber is provided with a plurality of communicating holes for defining a pump length according to the distance from the nozzle openings, along the longitudinal direction of the chambers at an interval equivalent to the pump length; and, as the driving electric fields, a preliminary driving electric field which causes the volumes of the chambers to temporarily increase and an ejection driving electric field which causes the volumes of the chambers to temporarily decrease subsequently to the preliminary driving electric field are generated in the side walls for substantially equal driving time.

According to the present invention as described above, the provision of communication holes for defining the pump length of the chamber enables a reduction of time during which the pressure in the chamber attenuates, and enables a reduction of time during which an ejection driving electric field is generated to reduce the driving time involved in the ejection, without deterioration of ink supply characteristics and ink ejection characteristics, thereby achieving high-speed printing with continuous ink ejection at a high speed.

BRIEF DESCRIPTION OF THE DRAWINGS

For a more better understanding of the present invention, reference is made of a detailed description to be read in conjunction with the accompanying drawings, in which:

FIG. 11 is an exploded perspective view showing another example of the head chip according to an embodiment mode of the present invention;

DETAILED DESCRIPTION OF THE PREFERRED EMBODIMENT

The detailed description of the present invention is made based on an embodiment mode of the present invention below.

(Embodiment Mode)

Figure 1:
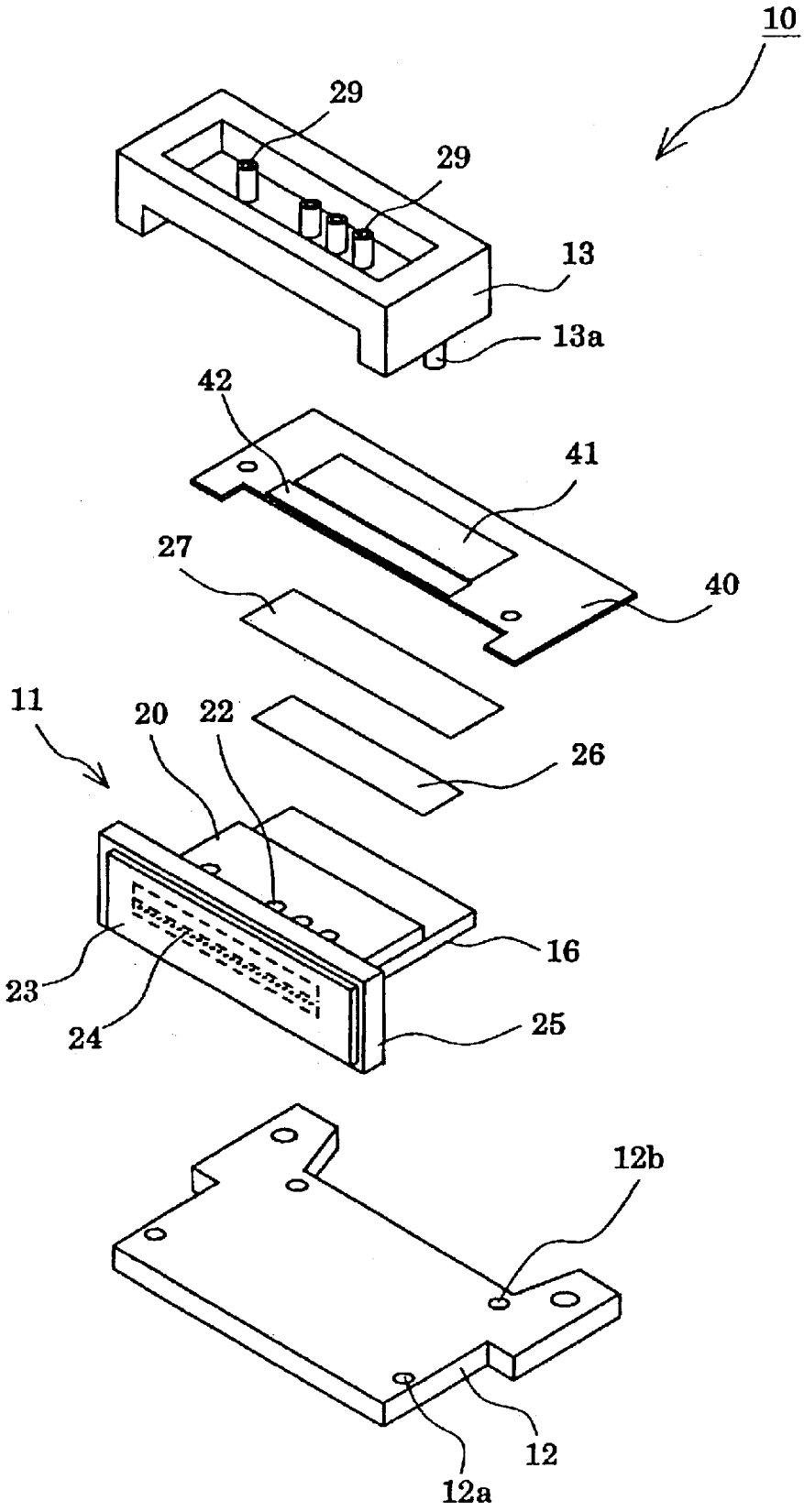
FIG. 1 is an exploded perspective view of an ink jet head according to an embodiment mode of the present invention.
Figure 2A:
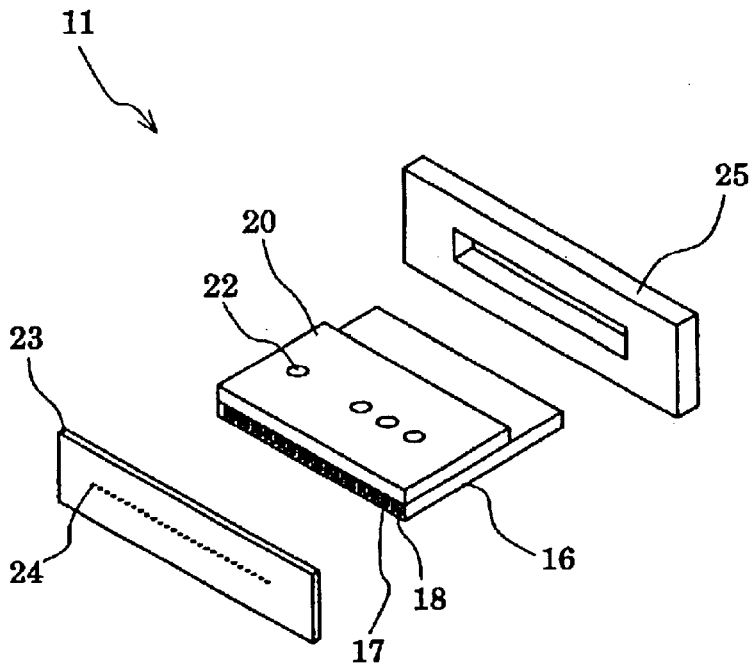
FIG. 2 is an exploded perspective view of a head chip according to an embodiment mode of the present invention.
Figure 2B:
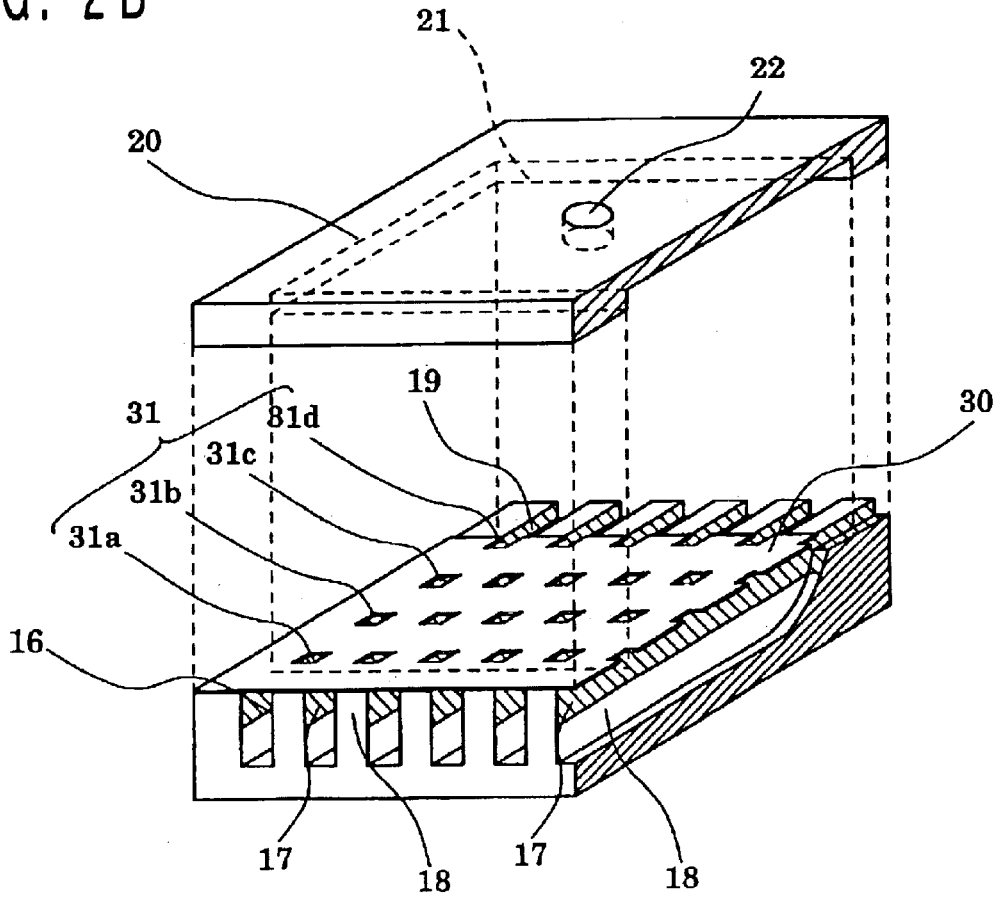
Figure 3A:
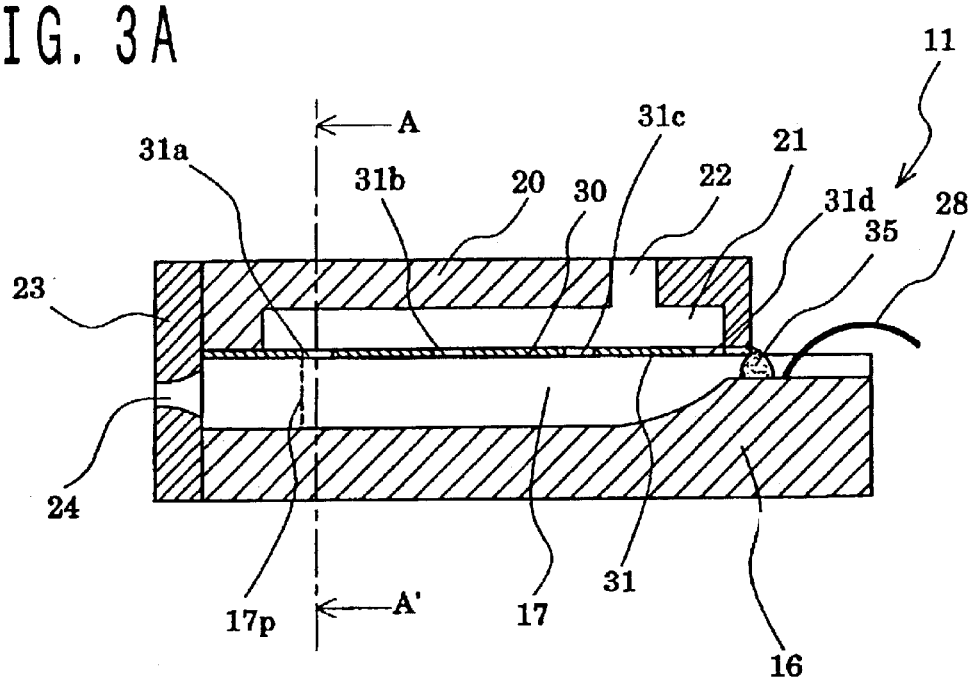
FIG. 3 is a cross-sectional view of a head chip according to an embodiment mode of the present invention, in which (a) is a cross-sectional view of a chamber in the longitudinal direction, and (b) is a cross-sectional view taken along a line A–A' of (a)
Figure 3B:
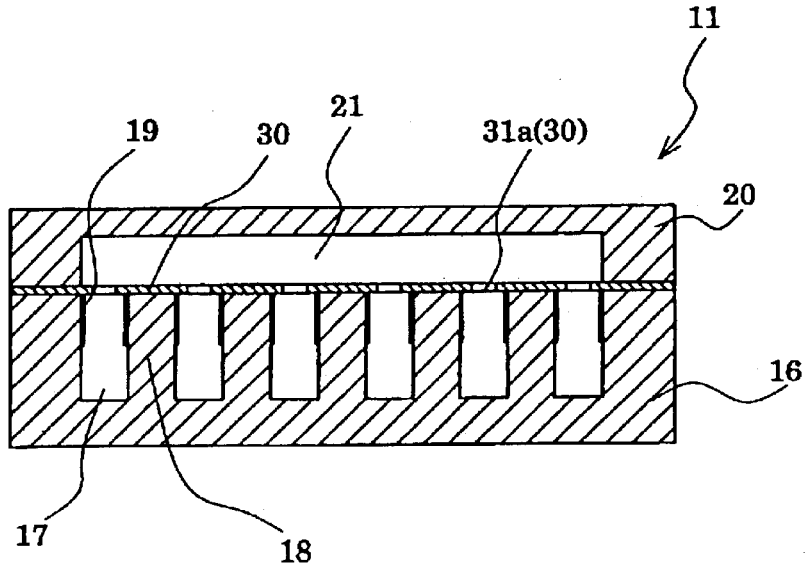
Figure 4A:
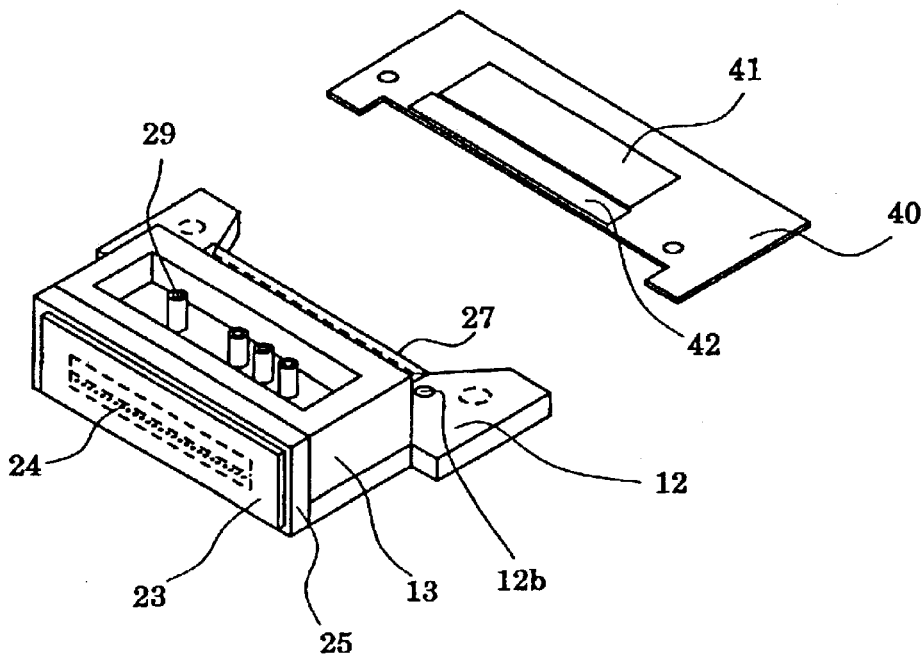
FIG. 4 is a perspective view showing a process for constructing an ink jet head according to an embodiment mode of the present invention.
Figure 4B:
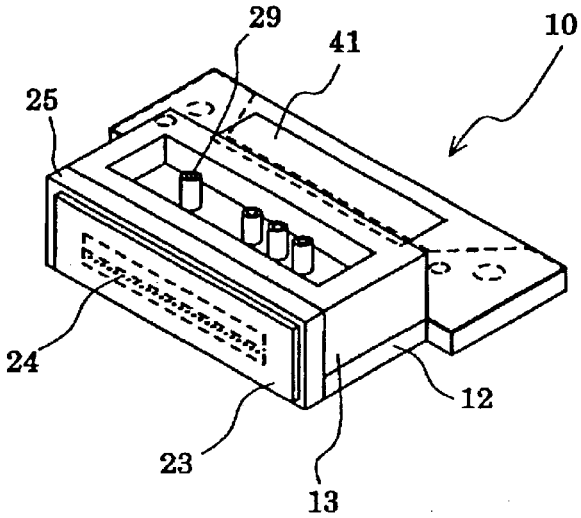

FIG. 1 is an exploded perspective view showing an ink jet head according to an embodiment mode of the invention; FIG. 2 is an exploded perspective view showing a head chip; FIG. 3(*a*) is a longitudinal cross-sectional view of a chamber of the head chip; FIG. 3(*b*) is a cross-sectional view taken along a line A–A' of FIG. 3(*a*); and FIG. 4 is a schematic perspective view showing a process for constructing the ink jet head.

As shown in FIG. 1, an ink jet head 10 according to this embodiment mode includes a head chip 11, a base plate 12 provided on one side of the head chip 11, a head cover 13 provided on the other side of the head chip 11, and a wiring substrate 40 having mounted thereon a driving circuit 41 for driving the head chip 11.

First, the head chip 11 is described in detail. As shown in FIGS. 2 and 3, in a piezoelectric ceramic plate 16 forming the head chip 11, chambers 17 composed of a plurality of grooves are disposed in parallel, and the chambers 17 are separated by side walls 18. One end portion in the longitudinal direction of each chamber 17 extends to one end surface of the piezoelectric ceramic plate 16, while the other end portion does not extend to the other end surface of the piezoelectric ceramic plate, making the chamber become gradually shallower. On an opening-side surface of both side walls 18 of each chamber 17, an electrode 19 for applying a driving electric field is formed along the longitudinal direction.

Here, each chamber 17 formed on the piezoelectric ceramic plate 16 is formed with, for instance, a disc-shaped dice cutter, the shape of which is utilized to form a portion where the chamber becomes gradually shallower. In addition, the electrode 19 formed inside each chamber 17 is formed through, for instance, well-known vapor deposition which is performed from an oblique direction.

An ink chamber plate 20 is bonded to the opening side of the chambers 17 of the piezoelectric ceramic plate 16 by an adhesive 35. The ink chamber plate 20 includes a common ink chamber 21 forming a recess portion for communicating with each chamber 17, and an ink supply port 22 disposed so as to be penetrated from the bottom portion of the common ink chamber 21 in the direction opposite to the chamber 17.

In this embodiment mode, the chambers 17 are divided into groups corresponding to ink colors of black (B), yellow (Y), magenta (M), and cyan (C), and four common ink chambers 21 and four ink supply ports 22 are provided.

The ink chamber plate 20 can be formed of a ceramic plate, a metal plate, or the like; in consideration of deformation or the like after it is bonded to the piezoelectric ceramic plate 16, the ink chamber plate 20 is preferably formed of a ceramic plate having a coefficient of thermal expansion close to that of the ink chamber plate 20.

Between the piezoelectric ceramic plate 16 and the ink chamber plate 20 as described above, there is provided a partitioning portion 30 formed of a plate member in which a plurality of communicating holes 31 for communicating the chambers 17 with the common ink chamber 21, which are in this embodiment mode four communicating holes 31*a* to 31*d* penetrated through the thickness direction, are provided along the longitudinal direction of the chamber 17.

Among the plurality of communicating holes 31 provided in the partitioning portion 30, the communicating hole 31*d* provided on the side of the rear end portion in the longitudinal direction of the chamber 17 is located at the position which faces the shallow end portion of the chamber 17 so as to prevent air bubbles within the chamber 17 from being accumulated in that end portion.

Also, the plurality of communicating holes 31 are provided at equally spaced intervals, and this interval corresponds to the distance between a nozzle opening 24 of the chamber 17 and the communicating hole 31*a* nearest the nozzle opening 24. This distance defines the pump length.

Here, when the region of the chamber which communicates with the common ink chamber is generally taken as a boundary portion, assuming that a pump portion is the region from the boundary portion to the nozzle opening, the length of the pump portion corresponds to the pump length of the chamber 17. The contraction time of from when vibration of the side walls stops after ink ejection until a pressure generated due to repeated reflections of a sound pressure within the chamber attenuates is determined by the length of the pump portion (the pump length).

In this embodiment mode, therefore, the communicating hole 31*a* disposed in the partitioning portion 30 at the position nearest the nozzle opening 24 is used, and the distance from the communicating hole 31*a* to the nozzle opening 24 is defined as a pump portion 17*p*, and the length thereof can be defined as the pump length.

More specifically, in this embodiment mode, if the length of the chamber 17 in the longitudinal direction is 7.2 mm, the dimensions of the communicating holes 31 are 60 $\mu$m×180 $\mu$m, the distance of the communicating hole 31*a* from the nozzle opening 24 is 1.8 mm, then, AP of the head chip 11 becomes 3.60 microseconds. On the other hand, AP is 3.54 microseconds if a conventional head chip having no partitioning portion is used, that is, if the head chip is not provided with a partitioning portion such that a common ink chamber is formed so as to be opened from the nozzle opening to the shallow end portion of the chamber from a distance of 1.8 mm.

Accordingly, the distance of the communicating hole 31*a* from the nozzle opening 24 can be defined as the pump length. Thus, the length of the pump portion 17*p* can be easily defined according to the position of the communicating hole 31*a*, and by thus defining the pump length according to the position of the communicating hole 31*a*, the apparatus becomes less susceptible to the contraction time of the pressure in the chamber due to variation of nozzle resistance. The provision of the plurality of communicating holes 31 enables the contraction time to be easily reduced.

In this embodiment mode, the partitioning portion 30 is made of a different member from that of the ink chamber plate 20, and is sandwiched between the piezoelectric ceramic plate 16 and the ink chamber plate 20. However, the present invention is not limited thereto, and, for instance, the partitioning portion 30 may be formed integrally on the piezoelectric ceramic plate 16 side of the ink chamber plate 20. There is no particular limitation on a method for forming such an ink chamber plate, and, for example, the ink chamber plate may be formed by etching a ceramic plate, or by mechanically machining a metal plate.

A nozzle plate 23 is further bonded to an end surface of a bonded body of the piezoelectric ceramic plate 16 and the ink chamber plate 20 in which the chambers 17 are opened. The nozzle opening 24 is formed at a position of the nozzle plate 23 which faces each chamber 17.

In this embodiment mode, the nozzle plate 23 has a larger area than the area of the end surface of the bonded body of the piezoelectric ceramic plate 16 and the ink chamber plate 20 in which the chambers 17 are opened. The nozzle plate 23 is formed of a polyimide film or the like in which the nozzle opening 24 is formed using, for instance, an excimer laser apparatus. Although not shown in the figures, a water-repellent film having a water-repellent property is provided on a surface of the nozzle plate 23 which faces a printed material so as to prevent adhesion of ink and the like.

In this embodiment mode, on the periphery of the end portion of the bonded body of the piezoelectric ceramic plate 16 and the ink chamber plate 20 in which the chamber 17 is opened, a nozzle support plate 25 is disposed. The nozzle support plate 25 is bonded to the outside of the bonded body end surface of the nozzle plate 23 to hold the nozzle plate 23 in a stable manner. Of course, the nozzle support plate 25 may not be necessarily provided.

For forming the head chip 11 having such a structure, first, the piezoelectric ceramic plate 16 is bonded with the ink chamber plate 20 so as to sandwich the partitioning portion 30 therebetween, and the nozzle plate 23 is bonded to the end surface of the bonded body. Then, the nozzle support plate 25 is engaged with and adhered to the outer surface of the nozzle plate 23 and to the bonded body of the piezoelectric ceramic plate 16 and the ink chamber plate 20, thereby forming the head chip.

Further, an ink jet head 10 according to this embodiment mode using the head chip 11 is described below.

As shown in FIGS. 1 and 4, in the ink jet head 10 according to this embodiment mode, on an end portion of the piezoelectric ceramic plate 16 forming the head chip 11 which is opposite to the nozzle opening 24 side, a wiring pattern (not shown) is formed so as to be connected with the electrode 19 via a bonding wire 28 and the like, and a flexible cable 27 is bonded to this wiring pattern through an anisotropic conductive film 26. On the rear end side of the nozzle support plate 25 of the bonded body of the piezoelectric ceramic plate 16 and the ink chamber plate 20, an aluminum base plate 12 that is disposed at the side of the piezoelectric ceramic plate 16, and a head cover 13 that is disposed at the side of the ink chamber plate 20 are joined together. The base plate 12 and the head cover 13 are fixed by engaging an engaging shaft 13*a* of the head cover 13 with an engaging hole 12*a* of the base plate 12. Both of them are used to sandwich the bonded body of the piezoelectric ceramic plate 16 and the ink chamber plate 20 therebetween. An ink introducing channel 29 is provided in the head cover 13 so as to be brought in communication with each of the ink supply ports 22 of the ink chamber plate 20.

As shown in FIG. 4(*a*), the wiring substrate 40 is fixed to the base plate 12 that is protruded at the rear end side of the piezoelectric ceramic plate 16. The driving circuit 41, such as an integrated circuit for driving the head chip 11 is mounted on the wiring substrate 40. The driving circuit 41 is connected with the flexible cable 27 through an anisotropic conductive film 42, thereby completing the ink jet head 10 shown in FIG. 4(*b*).

In such an ink jet head 10, ink is filled in the chambers 17 from the ink supply ports 22 via the ink introducing channels 29, and the driving circuit 41 causes a predetermined driving electric field to act on both side walls 18 of a predetermined chamber 17 via the electrode 19, thereby causing the side walls 18 to deform to change the volume of the predetermined chamber 17, whereby the ink in the chamber 17 is ejected from the nozzle opening 24.

Further, such an ink jet head 10 is combined with a tank holder 51 which retains ink cartridges (not shown) to form a head unit 50.

Figure 5A:
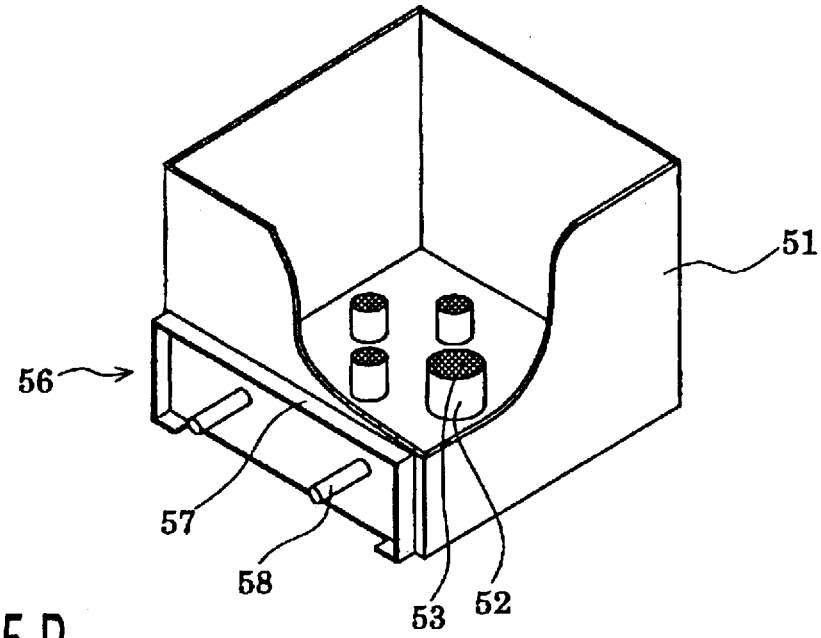
FIG. 5 is an exploded perspective view schematically showing a head unit according to an embodiment mode of the present invention.
Figure 5B:
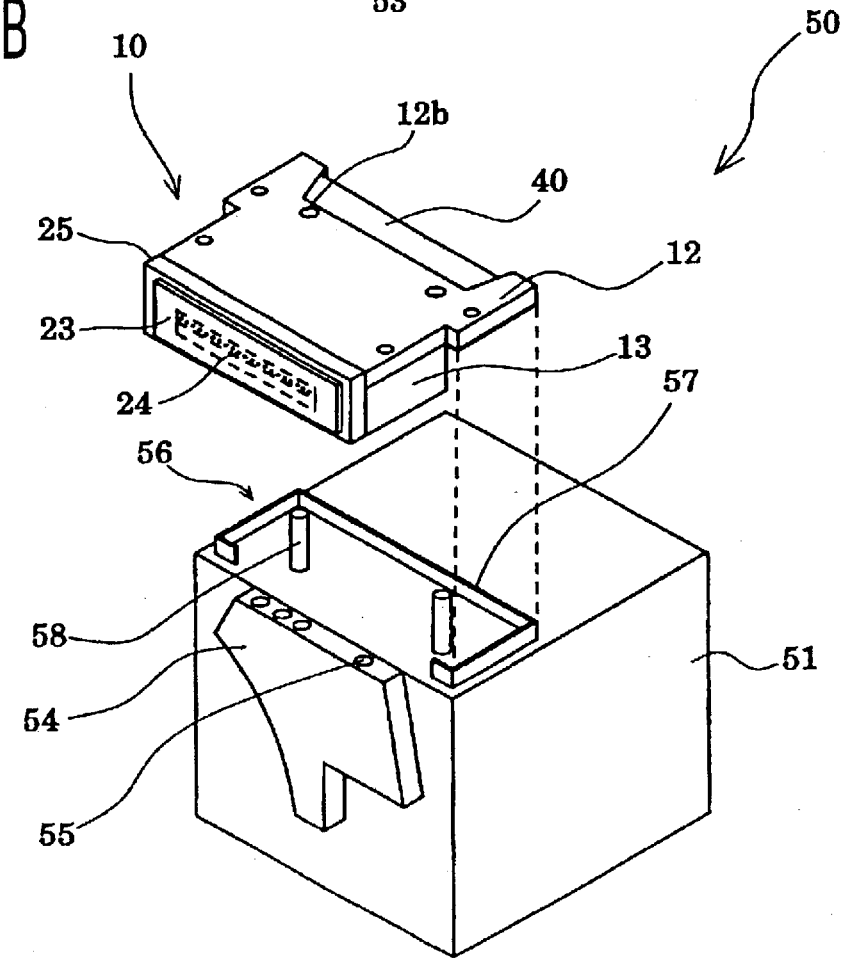

An example of the tank holder 51 is shown in FIG. 5. The tank holder 51 shown in FIG. 5 has a substantially box shape whose one surface is opened so that the ink cartridges can be held in an attachable and detachable manner. On the upper surface of the bottom wall, coupling portions 52 coupled with the ink supply ports 22 that are openings formed in the bottom of the ink cartridges are provided. For example, the coupling portions 52 are provided for ink colors of black (B), yellow (Y), magenta (M), and cyan (C), respectively. Ink passages (not shown) are formed in the coupling portions 52, and filters 53 are provided at the leading end of the coupling portions 52 in which the ink passages are opened. The ink passages formed in the coupling portions 52 are formed so as to be penetrated to the back surface side of the bottom wall, and the ink passages communicate with head coupling ports 55 that are opened in a side wall of a passage substrate 54 provided on the back surface side of the tank holder 51 via ink passages (not shown) in the passage substrate 54. The head coupling ports 55 are opened in the side surface of the tank holder 51, and a head holder portion 56 for holding the above-described ink jet head 10 is provided on the bottom of this side wall. The head holder portion 56 includes an upstanding enclosure wall 57 provided in a substantially U-shape so as to enclose the driving circuit 41 mounted on the wiring substrate 40, and an engaging shaft 58 which is within the enclosure wall 57 and which is engaged with engaging holes 12*b* provided in the base plate 12 of the ink jet head 10 and the wiring substrate 40.

Thus, the ink jet head 10 is mounted on the head holder portion 56, thereby completing the head unit 50. The ink introducing channels 29 formed in the head cover 13 are coupled with the head coupling ports 55 in the passage substrate 54. Thus, the ink introduced from the ink cartridges via the coupling portions 52 of the tank holder 51 is introduced into the ink introducing channels 29 of the ink jet head 10 through the ink passages in the passage substrate 54, and is filled into the common ink chamber 21 and the chambers 17 through the communicating holes 31.

The head unit 50 thus formed is mounted on a carriage of an ink jet recording apparatus for use, for example. One example of usage is schematically shown in FIG. 6.

Figure 6:
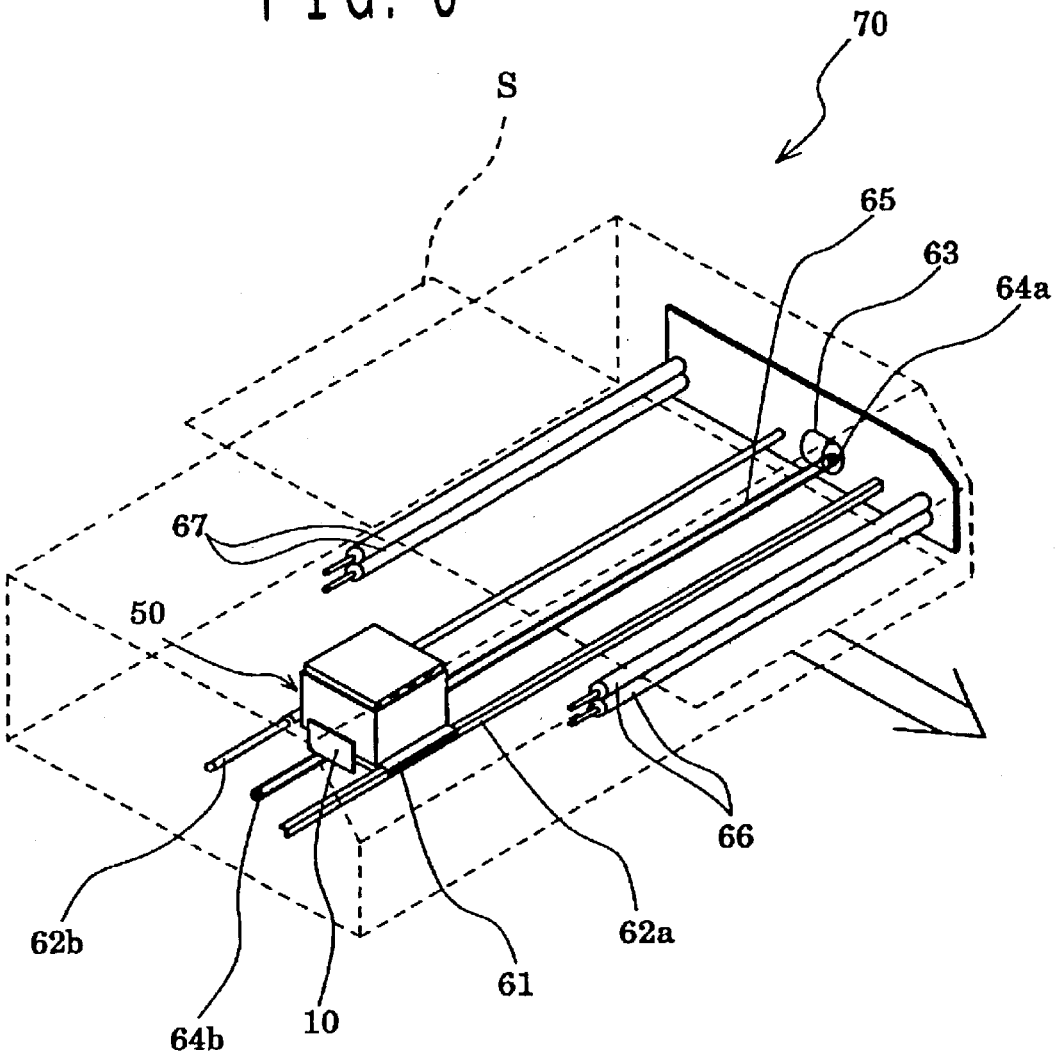
FIG. 6 is a schematic perspective view of an ink jet recording apparatus according to an embodiment mode of the present invention.

As shown in FIG. 6, a carriage 61 of an ink jet recording apparatus 70 is mounted on a pair of guide rails 62*a* and 62*b* so as to be movable in the axial direction. The carriage 61 is conveyed through a timing belt 65 traversed between a pulley 64*a* which is provided at one end side of the guide rails 62*a* and 62*b* and which is connected with a carriage driving motor 63 and a pulley 64*b* which is provided with the other end side thereof. A pair of conveying rollers 66 and a pair of conveying rollers 67 are provided along the guide rails 62*a* and 62*b* at both sides of a direction orthogonal to the direction in which the carriage 61 is conveyed. These conveying rollers 66 and 67 are for conveying a recording medium S to below the carriage 61 in a direction orthogonal to the direction in which the carriage 61 is conveyed.

The above-described head unit 50 is mounted on the carriage 61, and ink cartridges are held by the head unit 50 in an attachable and detachable manner.

In such an ink jet recording apparatus 70, while feeding the recording medium S, the carriage 61 scans in a direction orthogonal to the feeding direction, so that the ink jet head 10 enables characters and images to be recorded onto the recording medium S.

A driving method for the ink jet recording apparatus is now described in detail.

Figure 7:
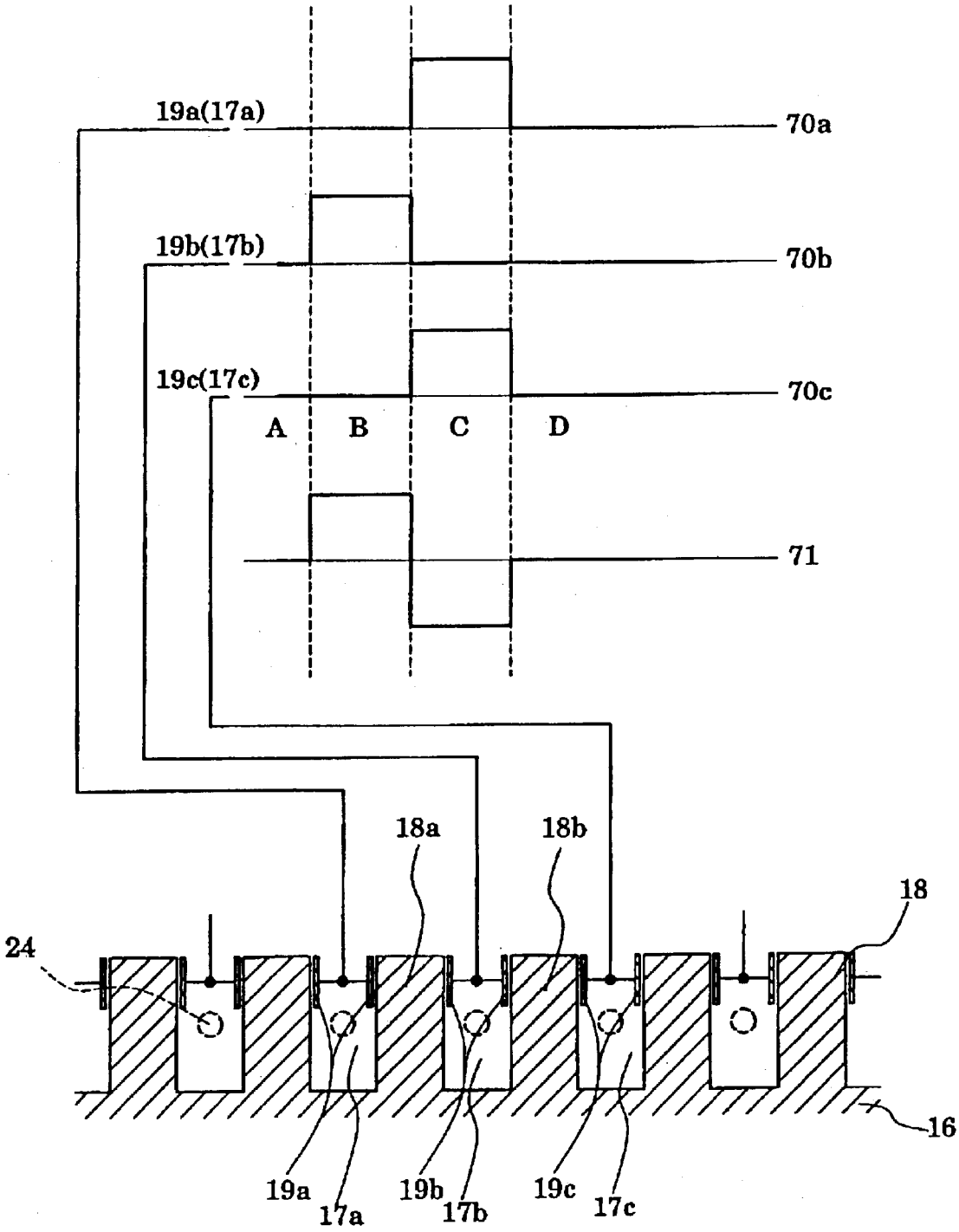
FIG. 7 is a pulse waveform showing a driving voltage and driving signal applied to side walls of a head chip according to an embodiment mode of the present invention, and a cross-sectional view of a piezoelectric ceramic plate.
Figure 8A:
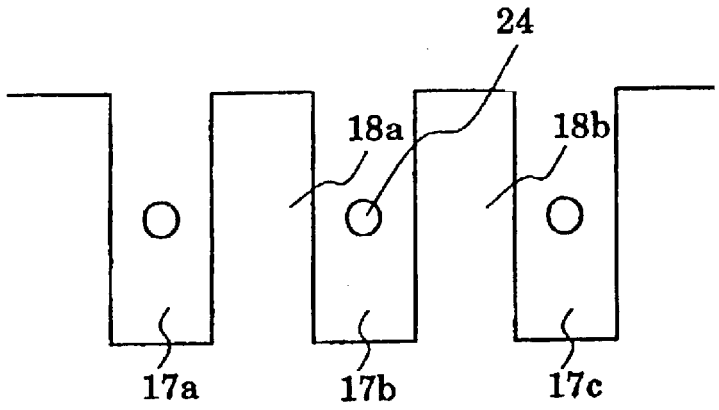
FIG. 8 is a cross-sectional view of the piezoelectric ceramic plate, showing movement of the side walls when an ink drop is ejected from the chamber according to an embodiment mode of the present invention.
Figure 8B:
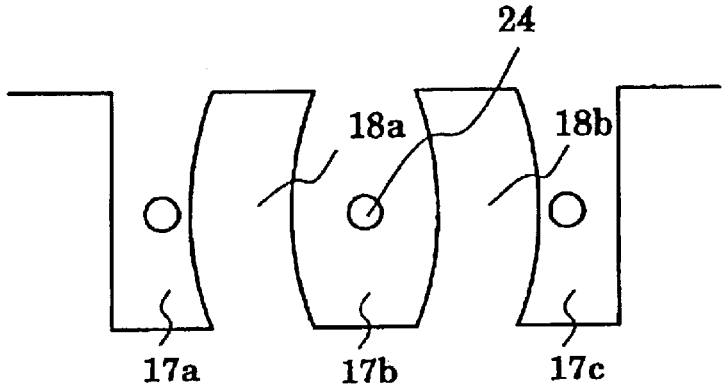
Figure 8C:
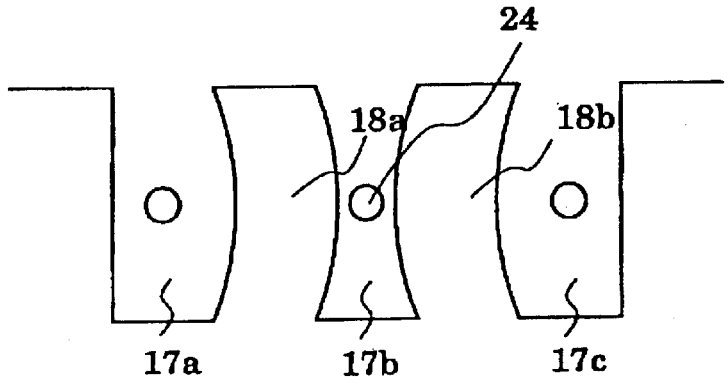
Figure 8D:
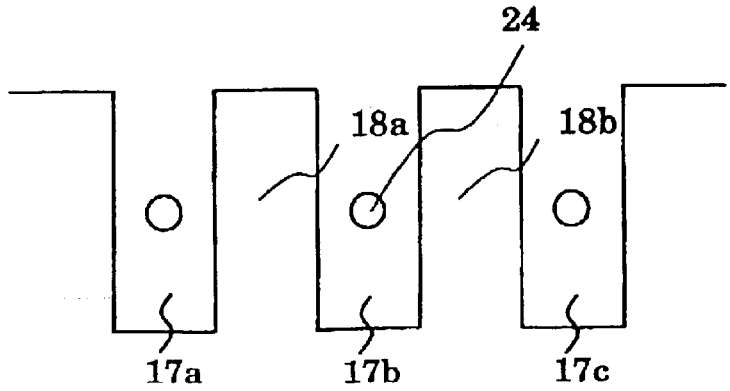

FIG. 7 is a pulse waveform showing a driving voltage and driving signal applied to the side walls of the head chip, and a cross-sectional view of the piezoelectric ceramic plate.

As shown in FIG. 7, in adjacent chambers 17*a*, 17*b*, and 17*c*, driving voltages indicated by pulse waveforms 70*a*, 70*b*, and 70*c* are applied to facing electrodes 19*a*, 19*b*, and 19*c* within the chambers 17*a*, 17*b*, and 17*c*, respectively, thereby generating electrode driving electric fields represented by a pulse waveform 71 on side walls 18*a* and 18*b* of the chamber 17*b* to cause ink drops to be ejected from the nozzle opening 24 corresponding to the chamber 17*b*.

The driving electric fields to be generated on the side walls 18*a* and 18*b* of the chamber 17*b* from which the ink drops are ejected include a preliminary driving electric field which causes the volume of the chamber 17*b* to temporarily increase, and an ejection driving electric field which causes the volume of the chamber 17*b* to temporarily decrease subsequently to the preliminary driving electric field.

The respective driving times of the preliminary driving electric field and of the ejection driving electric field are set to be substantially equal.

More specifically, the respective driving times of the preliminary driving electric field and of the ejection driving electric field are indicated as the pulse width of the pulse waveform 71 representing the driving electric fields. That is, in the pulse waveform 71 representing the driving electric field shown in FIG. 7, the preliminary driving electric field is indicated by a region B, and the ejection driving electric field is indicated by a region C.

The respective driving times of the preliminary driving electric field and of the ejection driving electric field, i.e., the widths of the region B and the region C of the pulse waveform 71 representing the driving electric fields are set to be substantially equal.

Now, movement of the side walls 18 of the head chip 11 which corresponds to the driving electric field consisting of the preliminary driving electric field and the ejection driving electric field is described in detail.

First, when an ink drop is ejected from the chamber 17*b*, the pulse waveform 70*b* representing a driving voltage applied to the electrode 19*b* indicates that a positive driving voltage is applied in the region B, while driving voltage applied to the electrodes 19*a* and 19*c* are grounded. This causes preliminary driving electric fields to be generated on the side walls 18*a* and 18*b*, thus causing the side walls 18*a* and 18*b* to deform outwards with respect to the chamber 17*b*.

Further, the pulse waveforms 70*a* and 70*c* representing driving voltages applied to the electrodes 19*a* and 19*c* in the chamber 17*a* and the chamber 17*c* have, in a region C subsequent to the region B of the pulse waveform 70*b*, waveforms for applying a reverse-directional driving voltage. This causes reverse-directional ejection driving electric fields to be generated on the side walls 18*a* and 18*b* subsequent to the preliminary driving electric field, thus causing the side walls 18*a* and 18*b* to deform inwards to the chamber 17*b*.

Therefore, by the pulse waveform 71 of the driving electric field shown in FIG. 7, when an ink drop is ejected from the chamber 17*b*, the preliminary driving electric field and the ejection driving electric field are generated on the side walls 18*a* and 18*b* of the chamber 17*b*, thereby causing the side walls 18*a* and 18*b* to deform outwards with respect to the chamber 17*b*, followed by deforming inwards, whereby the ink drop can be ejected.

FIG. 8 shows movement of the side walls 18*a* and 18*b* when an ink drop is ejected from the chamber 17*b* in response to the pulse waveform 71 of the driving electric field shown in FIG. 7. FIG. 8 is a cross-sectional view of the piezoelectric ceramic plate.

First, in a region A of the pulse waveform 71 shown in FIG. 7, the driving electric field is not generated on the side walls 18*a* and 18*b*, and, as shown in FIG. 8(*a*), the side walls 18*a* and 18*b* do not deform but wait for driving.

Then, in a region B of the pulse waveform 71 shown in FIG. 7 for the preliminary driving electric field, as shown in FIG. 8(*b*), the preliminary driving electric fields are generated on the side walls 18*a* and 18*b*, thereby causing the side walls 18*a* and 18*b* to deform outwards so as to be apart from each other to increase the volume of the chamber 17*b*. At this time, ink is replenished into the chamber 17*b* from the common ink chamber 21.

Next, in a region C of the pulse waveform 71 shown in FIG. 7 for the ejection driving electric field, as shown in FIG. 8(*c*), driving electric fields being reverse-directional to the preliminary driving electric fields are generated on the side walls 18*a* and 18*b*, thereby causing the side walls 18*a* and 18*b* to deform inwards so as to be close to each other from the state shown in FIG. 8(*b*). Thus, the volume of the chamber 17*b* decreases while the pressure increases in the chamber 17*b*, whereby an ink drop is ejected from the nozzle opening 24.

Thereafter, when the region C of the pulse waveform 71 shown in FIG. 7 for the ejection driving electric field terminates, and the driving electric fields generated on the side walls 18*a* and 18*b* becomes zero, the side walls 18*a* and 18*b* are returned to the original state, as shown in FIG. 8(*d*). The state shown in FIG. 8(*c*) transitions to the wait state for driving to increase the volume of the chamber 17*b*, thereby generating a negative pressure in the chamber 17*b*.

The driving times of the preliminary driving electric field and the ejection driving electric field are determined as natural-numbered multiples of AP that is a periodic time found from the length of the pump portion 17*p* and the pressure propagating speed of propagation within ink. Therefore, it goes without saying that the shortest driving times of the preliminary driving electric field and the ejection driving electric field are 1 AP.

Figure 9:
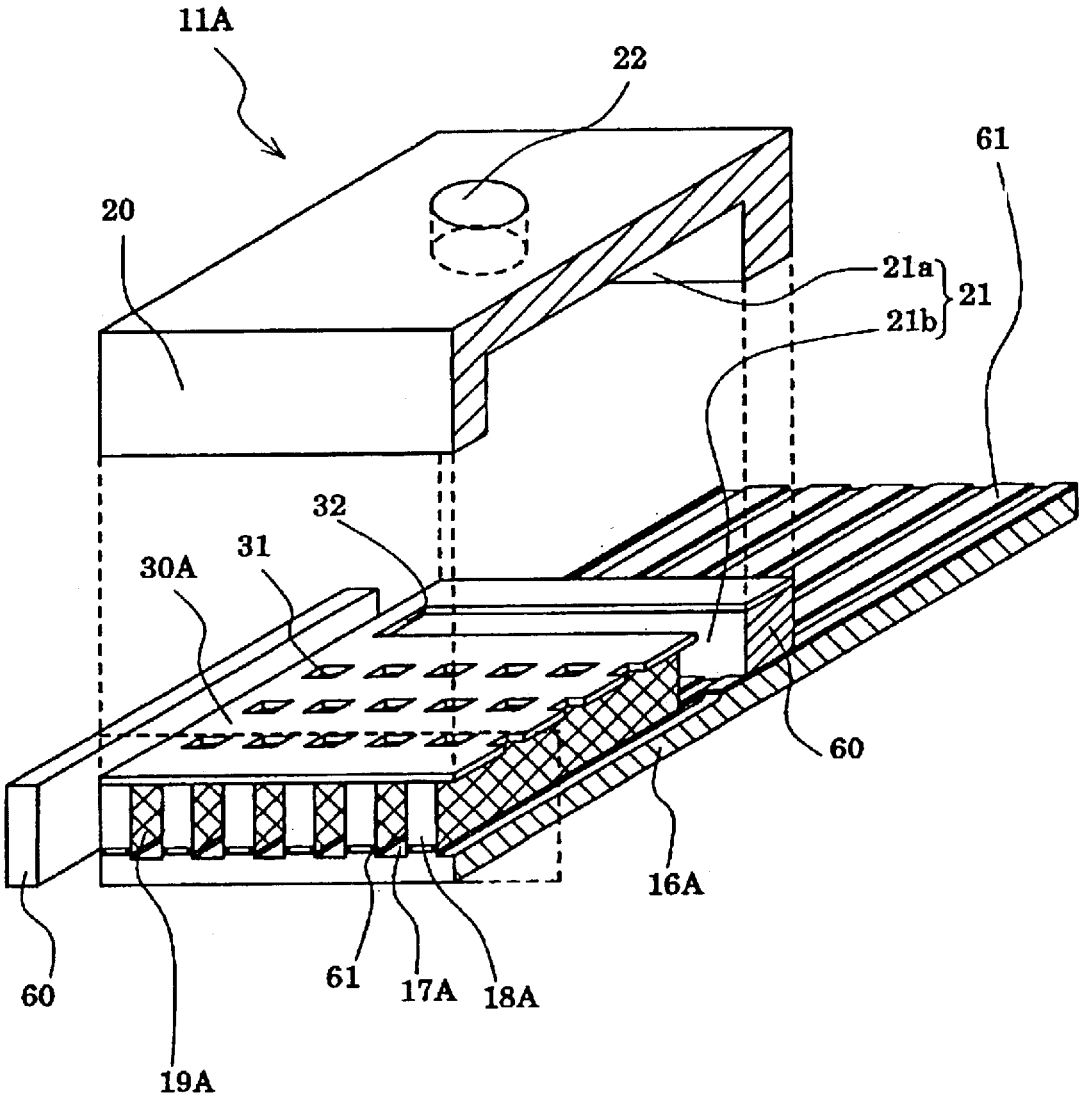
FIG. 9 is an exploded perspective view showing another example of the head chip according to an embodiment mode of the present invention.
Figure 10A:
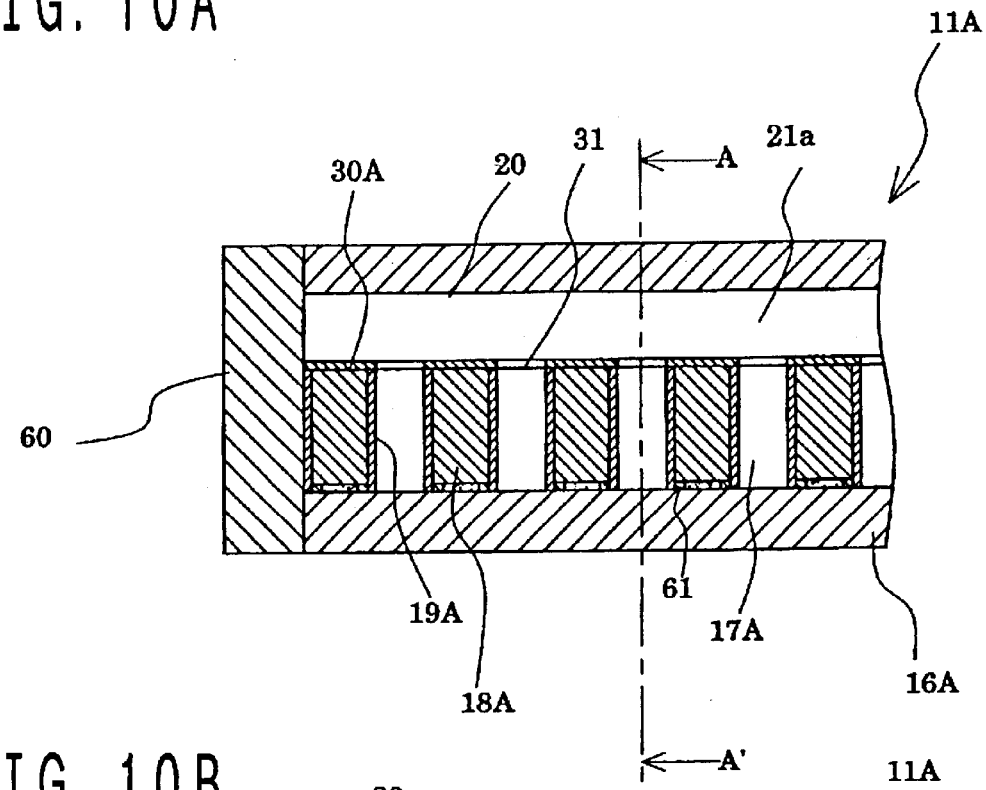
FIG. 10 is a cross-sectional view showing another example of the head chip according to an embodiment mode of the present invention, in which (a) is a cross-sectional view of chambers in juxtaposed direction thereof, and (b) is a cross-sectional view taken along a line A–A' of (a)
Figure 10B:
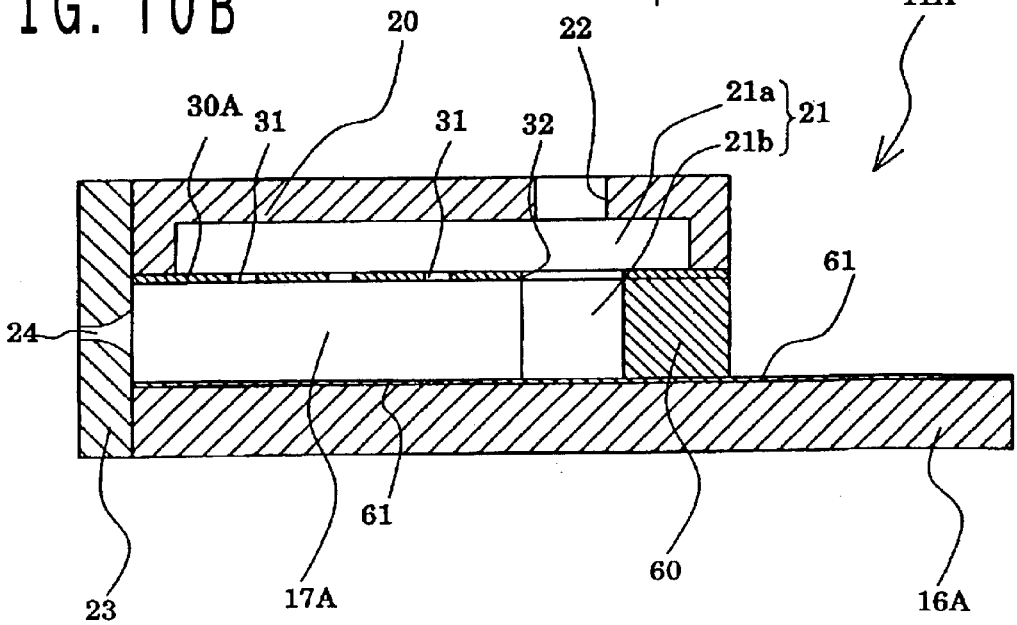

In this embodiment mode, the chambers 17 formed of grooves in the piezoelectric ceramic plate 16 are defined in the head chip 11; however, the present invention is not limited thereto. For example, side walls made of piezoelectric ceramic may be placed at a predetermined interval on a substrate. Such an example is shown in FIGS. 9 and 10. FIG. 9 is an exploded perspective view of another example of the head chip; FIG. 10(*a*) is a cross-sectional view of chambers in the head chip in its juxtaposed direction; and FIG. 10(*b*) is a cross-sectional view taken along a line A–A' of FIG. 10(*a*).

As shown in the figures, a head chip 11A includes side walls 18A made of piezoelectric ceramic disposed at a predetermined interval on a substrate 16A, and chambers 17A are defined between the side walls 18A.

A plurality of shielding plates 60 are further provided on the substrate 16A, and the shielding plates 60 define a second ink chamber 21*b* which communicates with one end in the longitudinal direction of the chambers 17A and which communicates with a first ink chamber 21*a* formed in an ink chamber plate 20 to form a part of the common ink chamber 21.

In a partitioning portion 30A, an ink supply communicating hole 32 is positioned so as to face the second ink chamber 21*b*, and a plurality of communicating holes 31 are provided at predetermined equal intervals between the chambers 17A and the first ink chamber 21*a*.

An electrode 19A provided on both side walls 18A of the chambers 17A is provided over the entirety of the side walls 18A, and the electrode 19A is electrically connected with the driving circuit 41 via a wiring 61. The electrode 19A is electrically connected with the wiring 61, for example, such that the wiring 61 extends along the chambers 17A defined at both sides between the substrate 16A and each of the side walls 18A so as to bring both end portions in the width direction of the extending wiring 61 into contact with the electrode 19A in a reliable manner, thereby achieving electrical connection between the electrode 19A and the wiring 61.

Also in such a head chip 11A, the provision of the communicating holes 31 in the partitioning portion 30A in order to determine the pump length of the chambers 17A allows the contraction time during which the pressures in the chambers 17A attenuate to be reduced and also ink supply characteristics and ink ejection characteristics can be improved. The shielding plates 60 may be brought into contact with end portions of the side walls 18A to remove the second ink chamber 21*b*, and one of the communicating holes 31 may be provided at an end portion of the side walls 18A.

In the embodiment mode described above, a head chip using insulating ink has been described by way of example; however, a head chip using conductive ink such as water-based ink may also be used.

When a head chip using conductive ink such as water-based ink is used, ink in the chambers 17 causes the electrodes to become conductive, thereby causing electrolysis of ink and making it impossible to perform correct operation. Therefore, chambers for ejecting ink and dummy chambers having no ink filled therewith are alternately arranged on a piezoelectric ceramic plate so as to eject the conductive ink. However, a partitioning portion may be used to prevent the ink from being filled into the dummy chambers.

Such an example is shown in FIG. 11. Note that FIG. 11 is an exploded perspective view showing another example of the head chip according to the present invention.

As shown in the figure, chambers 17*d* and dummy chambers 17*e* are alternately arranged on a piezoelectric ceramic plate 16 of a head chip 11B, and nozzle openings 24 are provided only on regions of a nozzle plate 23 which face the chambers 17*d*.

A partitioning portion 30B held between the piezoelectric ceramic plate 16 of the head chip 11B and the ink chamber plate 20 is provided with a plurality of communicating holes 31 that are formed at positions facing the chambers 17*d* at equally spaced intervals corresponding to the pump length. Regions facing the dummy chambers 17*e* are shielded by the partitioning portion 30B to prevent ink from being filled therein.

Also in the head chip 11B using conductive ink, the pump length of the chambers 17*d* is determined and the plurality of communicating holes 31 are provided in the partitioning portion 30B at an interval of the pump length, thereby reducing the contraction time during which the pressure in the chamber 17*d* attenuates and also improving ink supply characteristics and ink ejection characteristics.

If conductive ink is used for the head chip 11A, the above-mentioned partitioning portion 30B of the head chip 11B would cause ink to be supplied to all the chambers 17A through the second ink chamber 21*b*. If conductive ink is used for the head chip 11A, therefore, it is necessary to bring the shielding plate 60 into contact with end portions of the side walls 18A in order to remove the second ink chamber 21*b* and to provide the partitioning portion 30B; otherwise, it is necessary to modify the shape of the partitioning portion to provide dummy chambers having no ink filled therein.

In the head chips 11A and 11B, the ink chamber plate 20, and the partitioning portions 30A and 30B are made of different members; however, the present invention is not limited thereto. For example, the ink chamber plate 20, and the partitioning portions 30A and 30B may be integrally formed.

(Embodiment 1)

In Embodiment 1, the length of a head chip 11 similar to that of Embodiment Mode 1 described above, i.e., the length of the chamber 17 of the head chip 11 was 7.2 mm. The head chip 11 in which four communicating holes 31*a* to 31*d* of 60 $\mu$m×180 $\mu$m are provided in a partitioning portion so as to be 1.8 mm apart from each other was used.

In this Embodiment 1, the nozzle resistance of the head chip 11 is set to 60% and the ratio of the preliminary driving electric field to the ejection driving electric field when ink is ejected from the chamber 17 is set as 1 AP to 1 AP. As described above with respect to Embodiment Mode 1, 1 AP is 3.6 microseconds.

COMPARATIVE EXAMPLE 1

In this example, for comparison, a head chip 11 similar to that of Embodiment Mode 1 described above was designed so that the ratio of the preliminary driving electric field to the ejection driving electric field is 1 AP to 2 AP.

TEST EXAMPLE 1

Figure 12A:
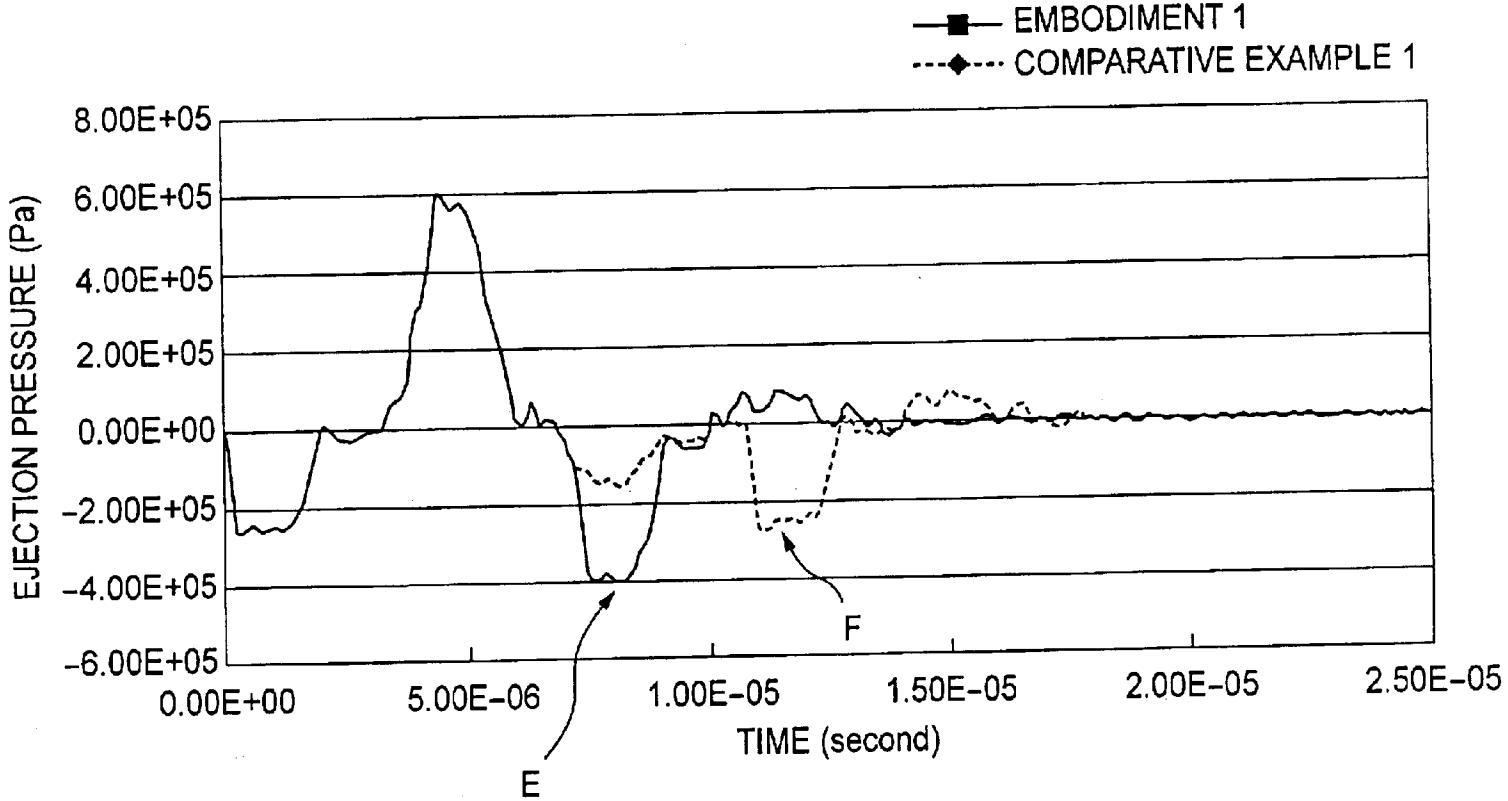
FIG. 12 is a plot depicting behavior of the pressure in the chamber with respect to time, after an application of the preliminary driving electric filed from a head chip of Embodiment 1 and Comparative Example 1, in which (b) is an enlarged view of the main portion of (a)
Figure 12B:
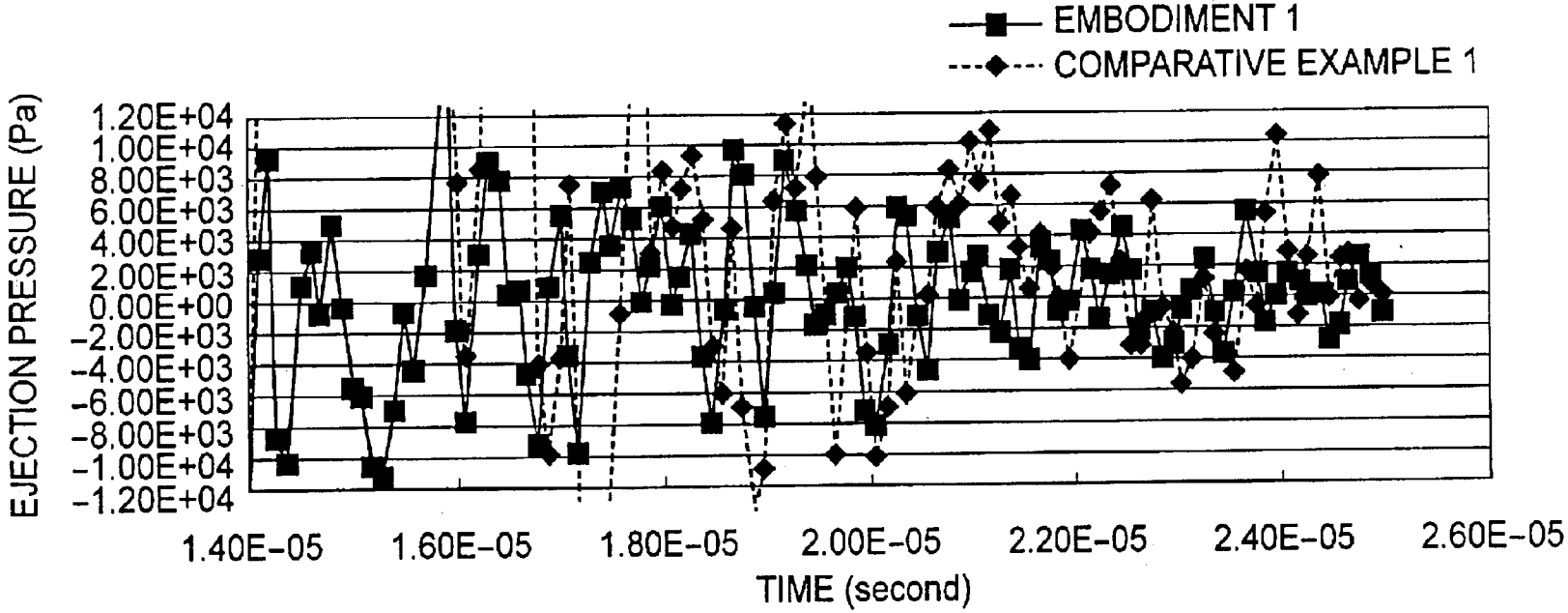
Figure 13:
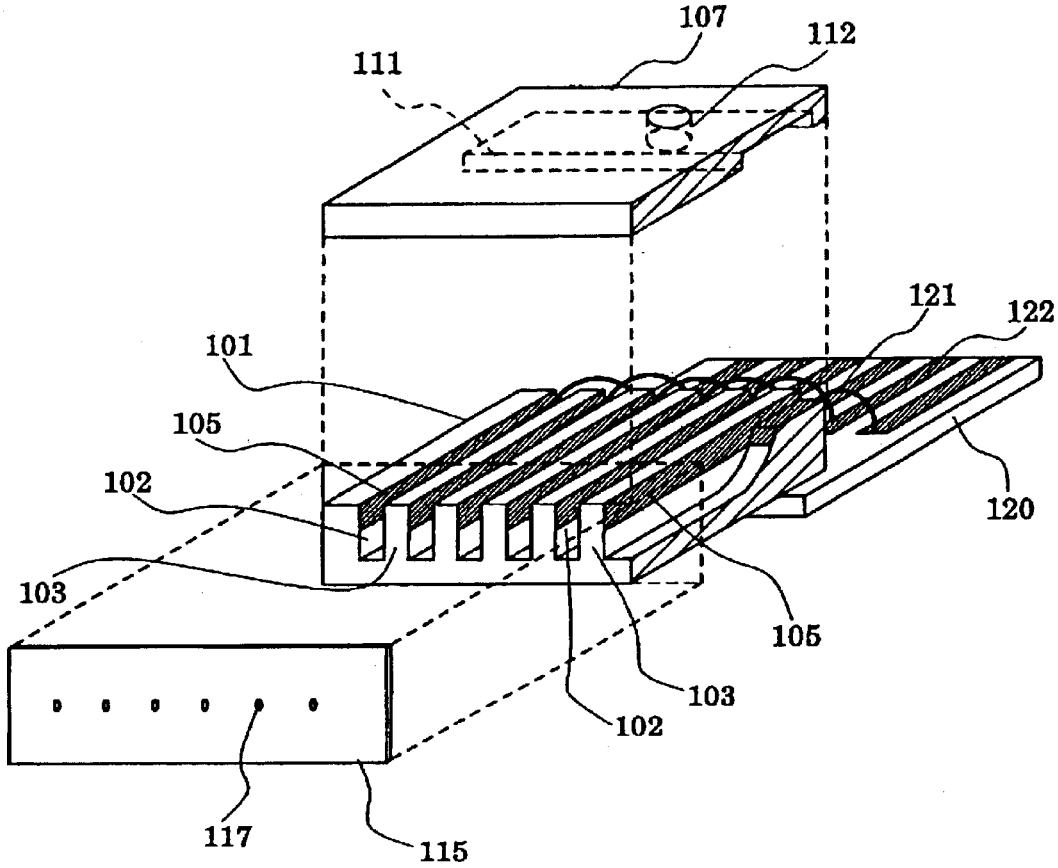
FIG. 13 PRIOR ART
FIG. 13 is an exploded perspective view schematically showing a head chip in the related art.
Figure 14A:
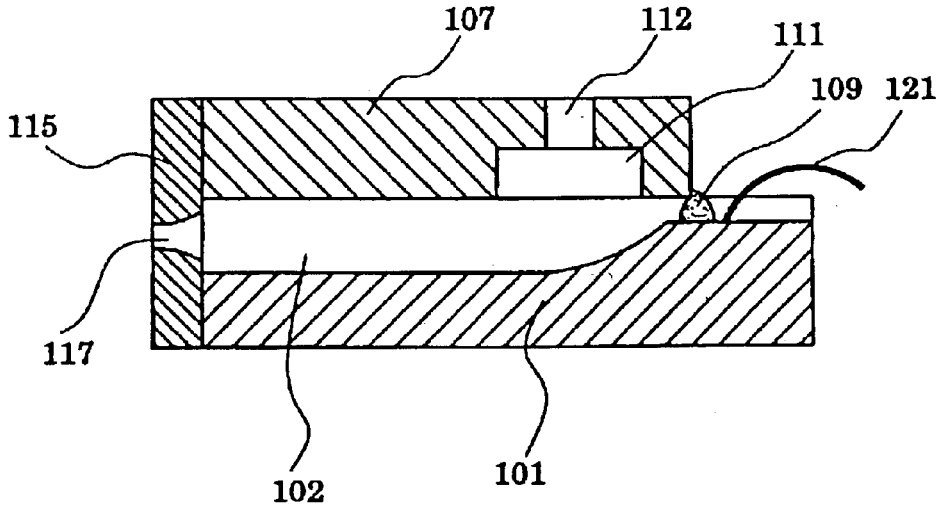
FIG. 14A PRIOR ART
FIG. 14 is a cross-sectional view schematically showing a head chip in the related art; and, FIG. 15 is a cross-sectional view schematically showing a head chip in the related art.
Figure 14B:
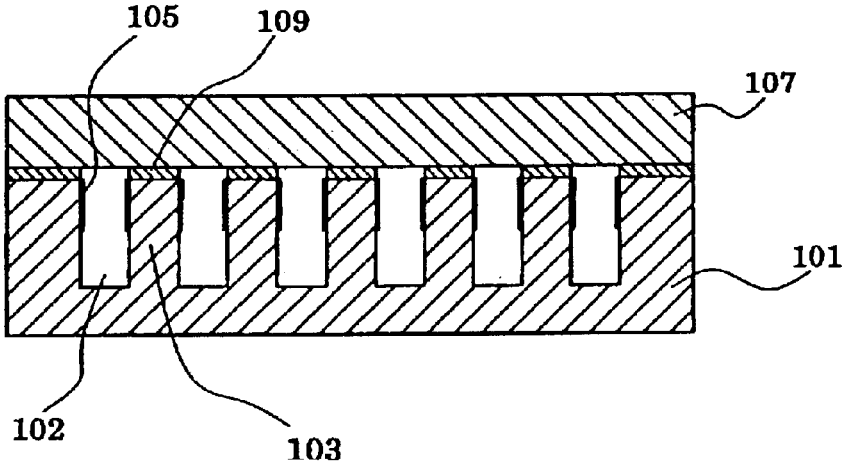
FIG. 14B PRIOR ART
Figure 15:
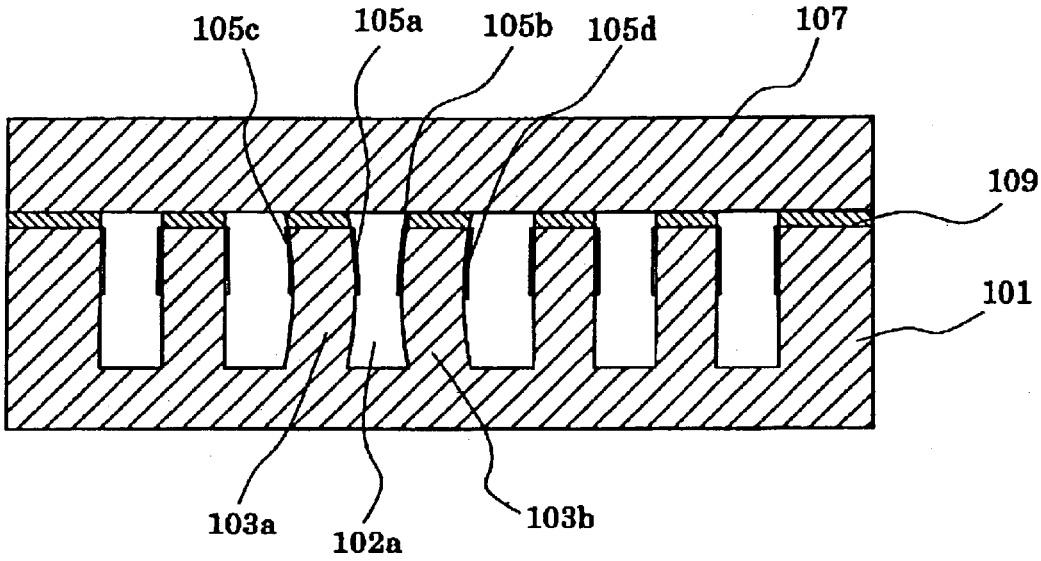
FIG. 15 PRIOR ART

The contraction time of the pressure in the chamber after ejection by driving the head chip 11 in Embodiment 1 and Comparative Example 1 was measured. The results are shown in FIG. 12. FIG. 12 is a plot depicting behavior of the pressure in the chamber with respect to time, after the preliminary driving voltage was applied from the head chip 11 in Embodiment 1 and Comparative Example 1; and FIG. 12(*b*) is an enlarged view of the main portion of FIG. 12(*a*).

As described above with reference to FIGS. 7 and 8, when the ejection driving electric field becomes zero, and the chamber volume is returned to the original volume, a negative pressure is generated in the chamber. The generated negative pressure is plotted in a region E of FIG. 12 for Embodiment 1, and in a region F of FIG. 12 for Comparative Example 1.

Thus, a timing when both side walls of the chamber is returned to the original state, that is, a timing when a negative pressure is generated is determined according to the difference in driving time of the ejection driving electric field. As regards the timing when a negative pressure is generated for canceling a positive pressure peak periodically generated after the ejection driving electric field is generated, if, because contraction of the pressure in the chamber becomes faster, it becomes unnecessary to make the periodically generated negative pressure peak and positive pressure peak to cancel each other, the time during which the pressure in the chamber contracts to allow ejection of the next ink drop is reduced.

It is found from the results shown in FIG. 12 that, as regards the time required for the pressure in the chamber to contract, which is in this case the time required for the pressure to become ±10 kPa or lower provided that the pressure in the chambers ready for the next ink drop ejection is defined as ±10 kPa or lower, it takes 16.0 microseconds in the head chip 11 of Embodiment 1 for contracting the pressure to a predetermined pressure or lower; on the other hand, it takes 24.1 microseconds in the head chip 11 of Comparative Example 1 for contracting the pressure to the predetermined pressure or lower.

It is therefore found that the contraction time of ejection pressure in the chamber per ejection in the head chip 11 of Embodiment 1 is about 8 microseconds shorter than that in the head chip 11 of Comparative Example 1

Such a shortened driving time of the ejection driving electric field can be achieved in a conventional head chip that is not provided with the partitioning portion 30 only in the case where the partitioning portion 30 in which a plurality of communicating holes 31 communicating with the chambers 17 and the common ink chamber 21 are provided along the longitudinal direction of the chambers 17 at an interval equivalent to the pump length is provided on the head chip 11 so that the contraction time of the pressure in the chambers 17 is reduced, because generation of a negative pressure occurring when the chamber volume is returned to the original volume after ejection coincides with the timing of a negative pressure peak generated after (2N−1)×AP since an application of ejection driving electric field, thus extraordinarily increasing the negative pressure.

In Embodiment 1 and Comparative Example 1, the ink drop ejection speed of arbitrary nozzle openings, in this text example the 30th, 222nd, and 480th nozzles of total 510 nozzles were measured. The results are shown in Table 1.

TABLE 1

| | Nozzle No. | 30th | 222nd | 480th |
|---|---|---|---|---|
| Ejection speed (m/s) | Embodiment 1 | 4.93 | 5.03 | 5.05 |
| | Comparative Example 1 | 5.05 | 4.98 | 5.15 |

As seen from the results shown in Table 1, it is found from comparison in driving timing between the head chip 11 of Embodiment 1 and the head chip 11 of Comparative Example 1 that the ink drop ejection speeds are substantially equal in both the case where the application time ratio of the preliminary driving electric field to the ejection driving electric field is set as 1 AP to 1 AP, and the case of the conventional driving electric field shown in Comparative Example 1, that is, in the case where the application time ratio of the preliminary driving electric field to the ejection driving electric field is set as 1 AP to 2 AP.

By driving the preliminary driving electric field and the ejection driving electric field for substantially equal driving time, in the case of Embodiment 1, the time required for driving can be reduced without changing the ink drop ejection speed from the ejection speed at a conventional driving timing, and the contraction time during which the pressure in the chamber attenuates after ejection can also be reduced. Therefore, the continuous ejection speed, that is, the printing speed can be increased.

Note that in Embodiment 1 and Comparative Example 1, the preliminary driving electric field is set to 1 AP and the ejection driving electric field is set to 1 AP or 2 AP, which are the shortest ejection times, but there is no particular limitation thereto. It is needless to say that, in Embodiment 1, it is sufficient that the respective driving times of the preliminary driving electric field and the ejection driving electric field be substantially equal to each other.

As described above, in the present invention, a plurality of communicating holes for defining a pump length according to the distance from a nozzle opening are provided in a partitioning portion of a common ink chamber along the longitudinal direction of chambers at an interval of the pump length, thereby reducing the contraction time during which the pressures in the chambers attenuate. In addition, the respective driving times of the preliminary driving electric field and the ejection driving electric field are made substantially equal to each other, thus reducing the driving time required for ejection to thereby increase the continuous ejection speed, i.e., the printing speed. Since the time it takes until the sound pressure attenuates does not depend upon the shape of the nozzle opening, it is possible to achieve control of the amount of ejection according to the shape of the nozzle opening under a constant ejection condition.

What is claimed is:

1. An ink jet recording apparatus comprising: a head chip having chambers defined in a substrate and communicating with nozzle openings at end portions in the longitudinal direction, and electrodes formed on side walls of the chambers; and driving means for applying driving voltages to the electrodes to generate driving electric fields in the side walls to change the volumes as causing ink filled inside to be ejected from the nozzle openings, wherein an ink chamber plate for defining a common ink chamber communicating with the chambers is bonded on the substrate; the common ink chamber is provided with a partitioning portion for partitioning the chambers and the common ink chamber, the partitioning portion being provided with a plurality of communicating holes for defining a pump length according to the distance from the nozzle openings, along the longitudinal direction of the chambers at an interval equivalent to the pump length; and the driving means performs driving so as to make substantially equal the driving time of a preliminary driving electric field that causes the volumes of said chambers to temporarily increase and the driving time of an ejection driving electric field that causes the volumes of the chambers to temporarily decrease subsequently to the preliminary driving electric field to cause the ink to be ejected, as the driving electric fields to be generated on the side walls.

2. An ink jet recording apparatus according to claim 1, wherein the partitioning portion is formed of a different member.

3. An ink jet recording apparatus according to claim 1, wherein the substrate is formed of a piezoelectric ceramic plate, and grooves are formed in the piezoelectric ceramic plate to define the chambers, the chambers communicating with the common ink chamber at openings in end portions in the longitudinal direction of the chambers which are opposite from the substrate.

4. An ink jet recording apparatus according to claim 1, wherein the side walls made of piezoelectric ceramic are arranged at a predetermined interval on the substrate, and the chambers are defined within the side walls and the common ink chamber is defined in the substrate, said chambers and the common ink chamber being communicated with each other at one end in the longitudinal direction of the chambers.

5. An ink jet recording method comprising applying voltages to electrodes of a head chip comprising a substrate having chambers communicating with nozzle openings at end portions in the longitudinal direction, and the electrodes formed on side walls of the chambers; and an ink chamber plate bonded on the substrate to define a common ink chamber communicating with the chambers, to change the volumes of the chambers to cause ink filled inside to be ejected from the nozzle openings, wherein the common ink chamber is provided with a plurality of communicating holes for defining a pump length according to the distance from the nozzle openings, along the longitudinal direction of the chambers at an interval equivalent to the pump length; and, as the driving electric fields, a preliminary driving electric field which causes the volumes of the chambers to temporarily increase and an ejection driving electric field which causes the volumes of the chambers to temporarily decrease subsequently to the preliminary driving electric field are generated in the side walls for substantially equal driving times.

* * * * *